US007647879B2

(12) United States Patent
del Valle Bravo et al.

(10) Patent No.: US 7,647,879 B2
(45) Date of Patent: Jan. 19, 2010

(54) BOAT COVER SUPPORT POLE

(76) Inventors: Facundo del Valle Bravo, 528 Sunset, White Lake, MI (US) 48383; Jose L. Correa, 2122 Baywood Dr., Fullerton, CA (US) 92833

( * ) Notice: Subject to any disclaimer, the term of this patent is extended or adjusted under 35 U.S.C. 154(b) by 0 days.

(21) Appl. No.: 12/023,140

(22) Filed: Jan. 31, 2008

(65) Prior Publication Data

US 2008/0202406 A1 Aug. 28, 2008

Related U.S. Application Data

(60) Provisional application No. 60/898,840, filed on Feb. 1, 2007.

(51) Int. Cl.
*B63B 17/00* (2006.01)

(52) U.S. Cl. ..... 114/361; 135/99; 248/354.1

(58) Field of Classification Search ..... 114/343, 114/361; 135/99, 141; 248/352, 354.1, 354.3
See application file for complete search history.

(56) References Cited

U.S. PATENT DOCUMENTS 1,691,411 A * 11/1928 Roth et al. ..... 135/99
2,390,986 A 12/1945 Burns
3,106,931 A * 10/1963 Cooper ..... 114/361
3,711,892 A 1/1973 Tabor
4,927,109 A * 5/1990 Wilson ..... 248/354.3
5,031,566 A 7/1991 Switzer
5,238,213 A * 8/1993 Pool ..... 248/352
5,479,872 A * 1/1996 Hulett ..... 114/361
5,593,239 A * 1/1997 Sallee ..... 135/99
6,308,653 B1 * 10/2001 Geraci ..... 114/361
7,025,015 B2 * 4/2006 Wilcox et al. ..... 114/255
7,093,558 B1 * 8/2006 Mandanici ..... 114/361
7,146,926 B1 * 12/2006 Yang ..... 114/361
7,347,159 B1 * 3/2008 Thompson ..... 114/361
7,353,833 B1 * 4/2008 Palmer ..... 135/99

* cited by examiner

*Primary Examiner*—Lars A Olson
(74) *Attorney, Agent, or Firm*—Harness, Dickey & Pierce, P.L.C.

(57) ABSTRACT

A support assembly for a boat cover includes a first support member having a first end disposed adjacent to the boat cover and a second end having an opening, a second support member having a first end telescopically received within the opening, and a biasing element disposed between the first end of the second support member and the first end of the first support member. The biasing element biases the first support member away from the second support member and into engagement with the boat cover.

23 Claims, 8 Drawing Sheets

BOAT COVER SUPPORT POLE

CROSS-REFERENCE TO RELATED APPLICATIONS

This application claims the benefit of U.S. Provisional Application No. 60/898,840, filed on Feb. 1, 2007. The disclosure of the above application is incorporated herein by reference.

FIELD

The present disclosure relates to support mechanisms and more particularly to a support mechanism for a boat cover.

BACKGROUND

The statements in this section merely provide background information related to the present disclosure and may not constitute prior art.

Boats and other watercraft are often stored outdoors alongside a dock and/or on hoists when not in use. Because conventional boats and watercraft typically include open areas, covers are often used to span at least a portion of the boat or watercraft to ensure that the open portion of the boat or watercraft is protected from the elements.

Conventional covers may be attached to the boat or watercraft by use of a releasable fastener such as a zipper or a snap. A pole is often used in conjunction with the zipper and snap arrangement to provide the cover with a desired pitch to prevent water and other debris from collecting on the cover. Cooperation between the pole and the removable fasteners provides the cover not only with the desired pitch, but also places the cover under tension to further enhance the ability of the cover in deflecting water and other debris away from the boat or watercraft.

While conventional poles adequately cooperate with removable fasteners to provide a cover for a boat or other watercraft with a desired pitch and/or tension, conventional pole arrangements are typically not biased into engagement with the cover such that the cover remains under tension during periods of inclement weather. Further, conventional pole arrangements can only be used with a single cover for a specified boat or watercraft. Conventional pole arrangements also do not include a locking mechanism that selectively and releasably attaches the pole arrangement to the cover.

SUMMARY

A support assembly for a boat cover includes a first support member having a first end disposed adjacent to the boat cover and a second end having an opening, a second support member having a first end telescopically received within the opening, and a biasing element disposed between the first end of the second support member and the first end of the first support member. The biasing element biases the first support member away from the second support member and into engagement with the boat cover.

In another aspect, a support assembly for a boat cover includes a first support member having an inner volume defined by at least one side wall and a top cap, whereby the top cap is disposed adjacent to the boat cover. A second support member is telescopically received within the inner volume and includes a surface opposing the top cap. A biasing element is disposed within the inner volume and between the top cap and the surface of the second support member to bias the first support member into engagement with the boat cover.

In yet another aspect, a support assembly for a boat cover includes a first support member having a first end disposed adjacent to the boat cover, a biasing element urging the first support member into engagement with the boat cover, and a locking mechanism disposed on the first end of the first support member. The locking mechanism includes a locking tab moveable between an extended position preventing removal the first support member from the boat cover and a retracted position permitting removal of the first support member from the boat cover.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
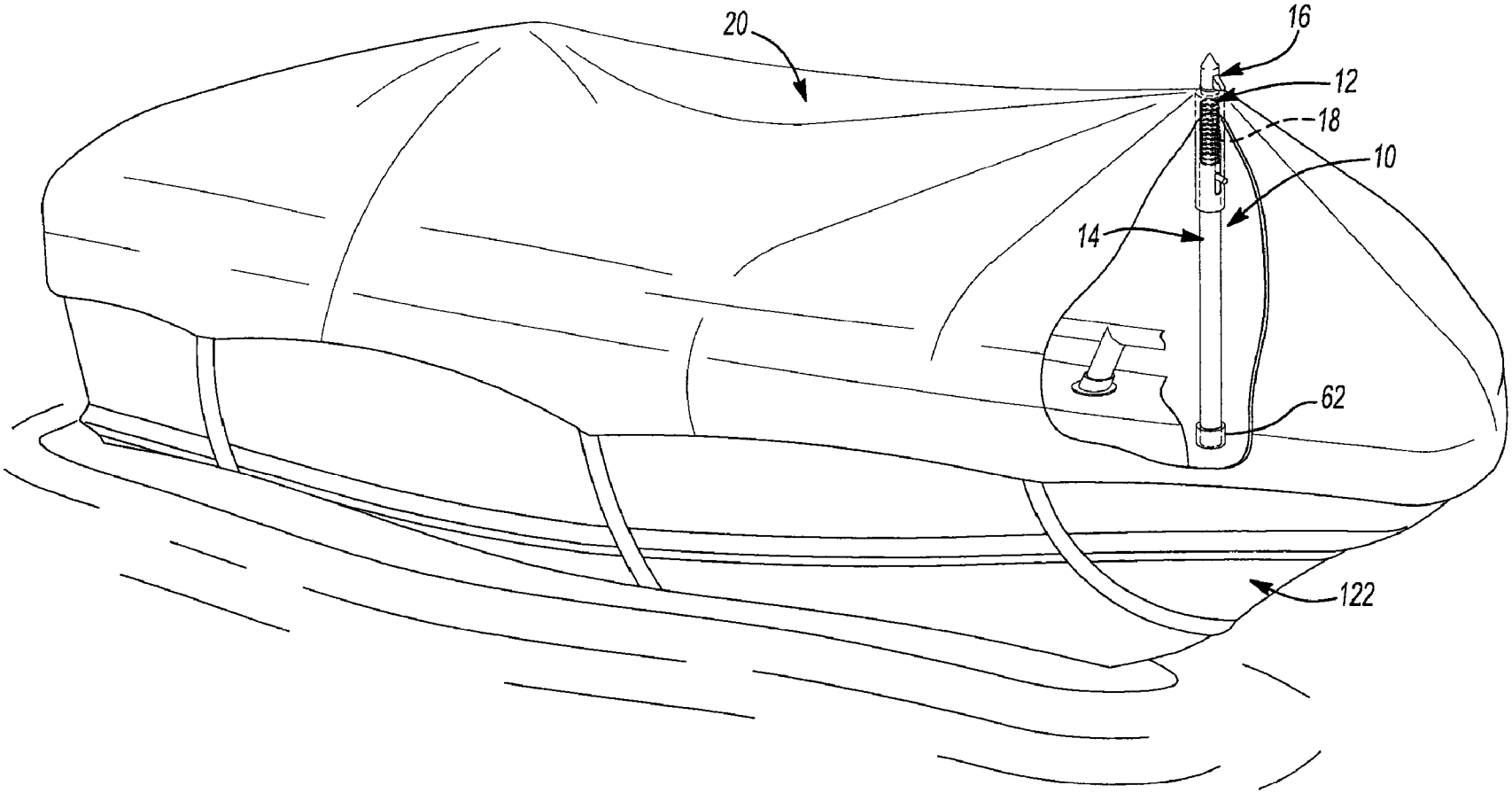
FIG. 1 is a perspective view of a boat incorporating a support pole in accordance with the principles of the present teachings for supporting a cover relative to the boat.

The following description is merely exemplary in nature and is not intended to limit the present disclosure, application, or uses. It should be understood that throughout the drawings, corresponding reference numerals indicate like or corresponding parts and features.

With reference to the figures, a support pole 10 is provided and includes an upper support member 12, a lower support member 14, and a locking mechanism 16. The lower support member 14 may be telescopically received within the upper support member 12 and may cooperate with a biasing element 18 to urge the upper support member 12 into engagement with a cover 20. The locking mechanism 16 may be associated with the upper support member 12 and may be moveable between an extended position, preventing removal of the upper support member 12 from the cover 20 and a retracted position permitting removal of the upper support member 12 from the cover 20. While the cover 20 is shown and described as a boat cover (FIG. 1), the support pole 10 of the present teachings may be used with any cover where maintaining a pitch and/or tension in the cover is desired.

The upper support member 12 may be an elongated cylindrical member having a cylindrical body 22 that cooperates with a top cap 24 to define an inner volume 26. The cylindrical body 22 may extend generally from the top cap 24 to an opening 28 and may include at least one slot 30 that extends along a length of the cylindrical body 22 and an indicator 31 disposed on an outer diameter thereof and generally approximate to the slot 30.

The indicator 31 may have a plurality of graduations 33 that extend generally perpendicular to the slot 30 and are numerically marked to correspond to a magnitude of a force acting axially with respect to the upper support member 12. The graduations 33 and markings may be inscribed on an outer diameter of the cylindrical body 22 by etching, laser marking, labeling or any suitable manner.

The graduations 33 may increase in value between a first graduation disposed proximate to a first end of the slot 30 near opening 28 and a second graduation disposed proximate to a second end of the slot 30 near the top cap 24. While the indicator 31 has been described as having graduations 33 indicating the magnitude of an axial force, the indicator 31 could additionally or alternatively be configured to indicate other variables such as relative movement between the upper support member 12 and the lower support member 14. Furthermore, while the graduations 33 have been described as being numerically marked, the graduations 33 could be marked with alphabetic characters, such as "Min." and "Max.," or alphanumerically.

The top cap 24 is positioned on the cylindrical body 22 generally on an opposite end of the cylindrical body 22 from the opening 28 and may include an engagement surface 32 facing the inner volume 26 and a post 34 formed on an opposite side of the top cap 24 from the engagement surface 32.

The post 34 may be positioned on the upper support member 12 and may be used to attach the upper support member 12 to the cover 20. To facilitate insertion of the post 34 into the cover 20, the post 34 may include a tapered end 36. An opening 38 of the cover 20 may include an eyelet 40 sized to receive the post 34 such that the post 34 is in close proximity to an inner diameter of the eyelet 40 and only a slight gap 42 is created between the post 34 and the eyelet 40. Because the eyelet 40 is sized to receive the post 34, the tapered end 36 may be used to direct the post 34 into the eyelet 40 of the opening 38 to facilitate insertion of the post 34 into the cover 20.

The post 34 may also include a recess 44 that supports the locking mechanism 16 between the extended position and the retracted position. The recess 44 may be positioned generally between the top cap 24 and the tapered end 36 such that when the locking mechanism 16 is in the extended position, the cover 20 is disposed generally between the recess 44 and the top cap 24. The recess 44 may include a shape that permits the locking mechanism 16 to be retracted into the recess 44 in the retracted position such that the locking mechanism 16 is either flush with or recessed from an outer surface 46 of the post 34.

The lower support member 14 may be telescopically received within the upper support member 12 and may similarly be an elongate cylindrical member. The lower support member 14 may include a cylindrical body 48 cooperating with a top cap 50 to define an inner volume 52. The cylindrical body 48 may extend generally from the top cap 50 to an opening 54 and may include a pair of upper apertures 56 and a series of attachment apertures 58.

The top cap 50 may be disposed on an opposite end of the cylindrical body 48 from the opening 54 and may include an engagement surface 60 for interaction with the biasing element 18. The opening 54 may receive a boot 62 that axially surrounds the opening 54. The boot 62 may be formed of a rigid material or alternatively may be formed of a flexible, slip-resistant material such as rubber to prevent movement of the lower support member 14 relative to an external structure 64. The boot 62 may include a drainage aperture 63 extending therethrough and into the inner volume 52. The drainage aperture 63 permits water or other fluids to drain from the inner volume 52.

The support pole 10 may be used on its own to place the cover 20 under tension, or, alternatively, the support pole 10 may be used in conjunction with a prior art pole device (not shown) to place the cover 20 under tension. If the support pole 10 is used as a stand alone device, the boot 62 may be received over the opening 54 to prevent movement of the lower support member 14 relative to the external structure 64. If the support pole 10 is used in conjunction with an existing support pole to lengthen the existing pole and place a cover 20 under tension, the boot 62 may be removed from the lower support member 14 to allow the existing support pole to be received generally within the inner volume 52 of the lower support member 14. Once the existing pole is received within the inner volume 52 of the lower support member 14, fasteners (not shown) may be inserted into the attachment aperture 58 to fixedly attach the existing support pole to the lower support member 14.

When the support pole 10 is used as a stand alone support, the length of the lower support member 14 may be adjusted as needed. Specifically, when the distance between the external structure 64 and the cover 20 are great, the upper support member 12 and/or lower support member 14 may be lengthened to accommodate the distance between the external structure 64 and the cover 20. Alternatively, when the distance between the external structure 64 and the cover 20 is small, the length of the upper support member 12 and/or lower support member 14 may be adjusted to accommodate the shorter distance between the external structure 64 and the cover 20.

The lower support member 14 may be slideably received within the opening 28 of the upper support member 12 such that the top cap 50 of the lower support member 14 is disposed generally within the inner volume 26 of the upper support member 12. Once the lower support member 14 is inserted into the upper support member 12, a pin 66 may be inserted into the upper apertures 56 such that the pin 66 extends through the lower support member 14 and through the slots 30 of the upper support member 12. The pin 66 may extend through the slots 30 and may be aligned with a portion of the indicator 31. A plurality of collars 68 may be used to maintain the position of the pin 66 relative to the upper and lower support members 12, 14. Each of the collars 68 may be received within a groove 70 formed in both ends of the pin 66 to prevent movement of the pin 66 relative to the lower support member 14. Interaction between the pin 66 and the slots 30 of the upper support member 12 define the range of motion of the upper support member 12 relative to the lower support member 14, as movement of the upper support member 12 relative to the lower support member 14 is generally defined by the overall length of the slots 30. The relative movement between the upper support member 12 and the lower support member 14 defines the relative movement between the pin 66 and the indicator 31. While a plurality of collars 68 and a groove 70 on both ends of the pin 66 is disclosed, any device capable of preventing movement of the pin 66 relative to the lower support member 14 such as, but not limited to, a cotter pin, spring loaded clevis pin, dowel pin, hair pin, or expansion pin, is anticipated.

The locking mechanism 16 may be supported by the post 34 of the upper support member 12 and may be moveable between an extended position preventing removal of the post 34 from the eyelet 40 of the cover 20 and a retracted position permitting removal of the post 34 from the eyelet 40. The locking mechanism 16 may include a locking tab 72 and a biasing member 74. The locking tab 72 may be rotatably supported within the recess 44 by a pin 76 and may include a tapered surface 78, an arcuate surface 80, and an engagement surface 82.

The tapered surface 78 may extend generally from the pin 76 to the arcuate surface 80 and may facilitate insertion of the post 34 into the eyelet 40 of the cover 20. The arcuate surface 80 may extend generally between the tapered surface 78 and the engagement surface 82 and may prevent removal of the cover 20 when the locking mechanism 16 is in the extended position. The engagement surface 82 may extend generally from the pin 76 to the arcuate surface 80 for interaction with the biasing member 74. The biasing member 74 may be disposed within the recess 44 and may apply a rotational force on the engagement surface 82 of the locking tab 72 to bias the locking tab in the counterclockwise direction relative to the view shown in FIG. 5 and into the extended position. While the biasing member 74 is shown as a leaf spring, any suitable biasing member such as, but not limited to, a coil spring or linear spring, is anticipated.

Figure 3:
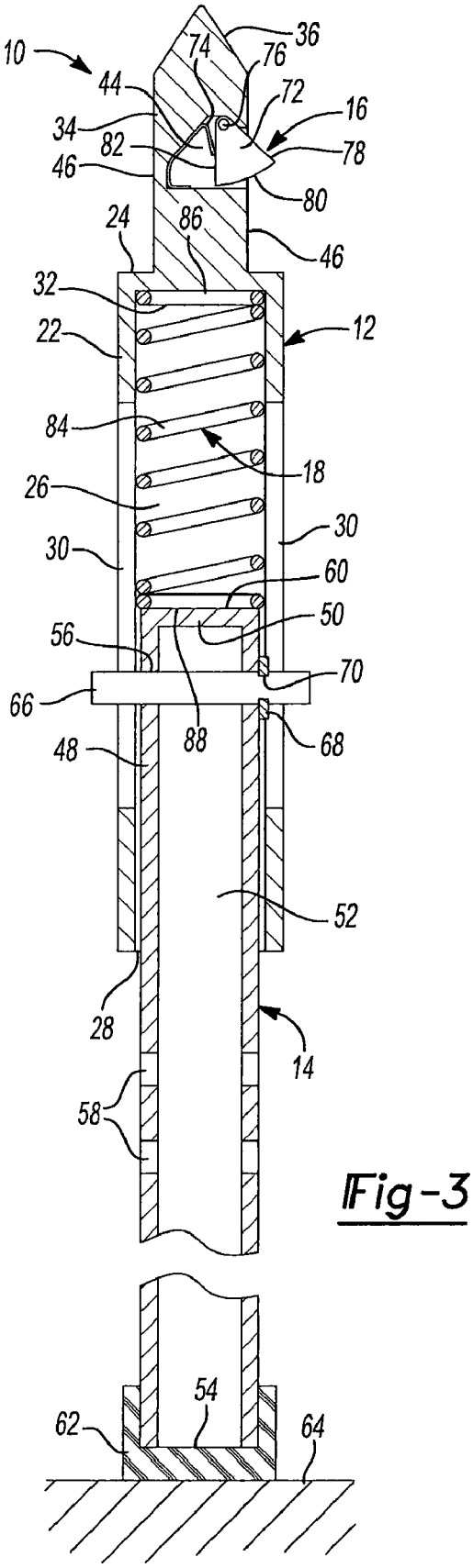
FIG. 3 is a cross-sectional view of the support pole of FIG. 2 in an extended position.
Figure 4:
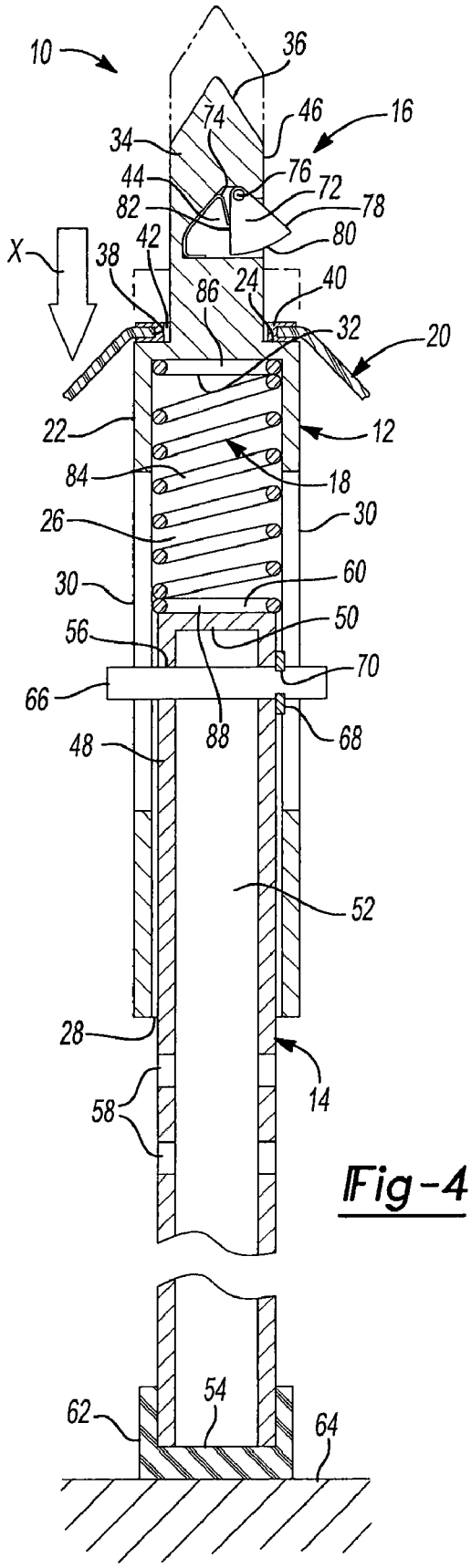
FIG. 4 is a cross-sectional view of the support pole of FIG. 2 in a deflected position with part of a cover shown to illustrate the relationship between the support pole and a cover.

With reference to FIGS. 3 and 4, the biasing element 18 is shown as being disposed within the inner volume 26 of the upper support member 12 such that the biasing member 18 is disposed generally between the upper support member 12 and the lower support member 14. The biasing element 18 may include a coiled body 84, a first end 86, and a second end 88. The first end 86 may be in contact with the engagement surface 32 of the upper support member 12 while the second end 88 may be in contact with the engagement surface 60 of the lower support member 14. The biasing element 18 may exert a force on the upper support member 12 due to engagement between the first end 86 of the biasing element 18 and the top cap 24 of the upper support member 12 and engagement between the second end 88 of the biasing element 18 and the top cap 50 of the lower support member 14. The force exerted by the biasing element 18 on the upper support member 12 urges the upper support member 12 into engagement with the cover 20 to provide the cover 20 with a desired pitch and also to place the cover 20 under tension.

Figure 5:
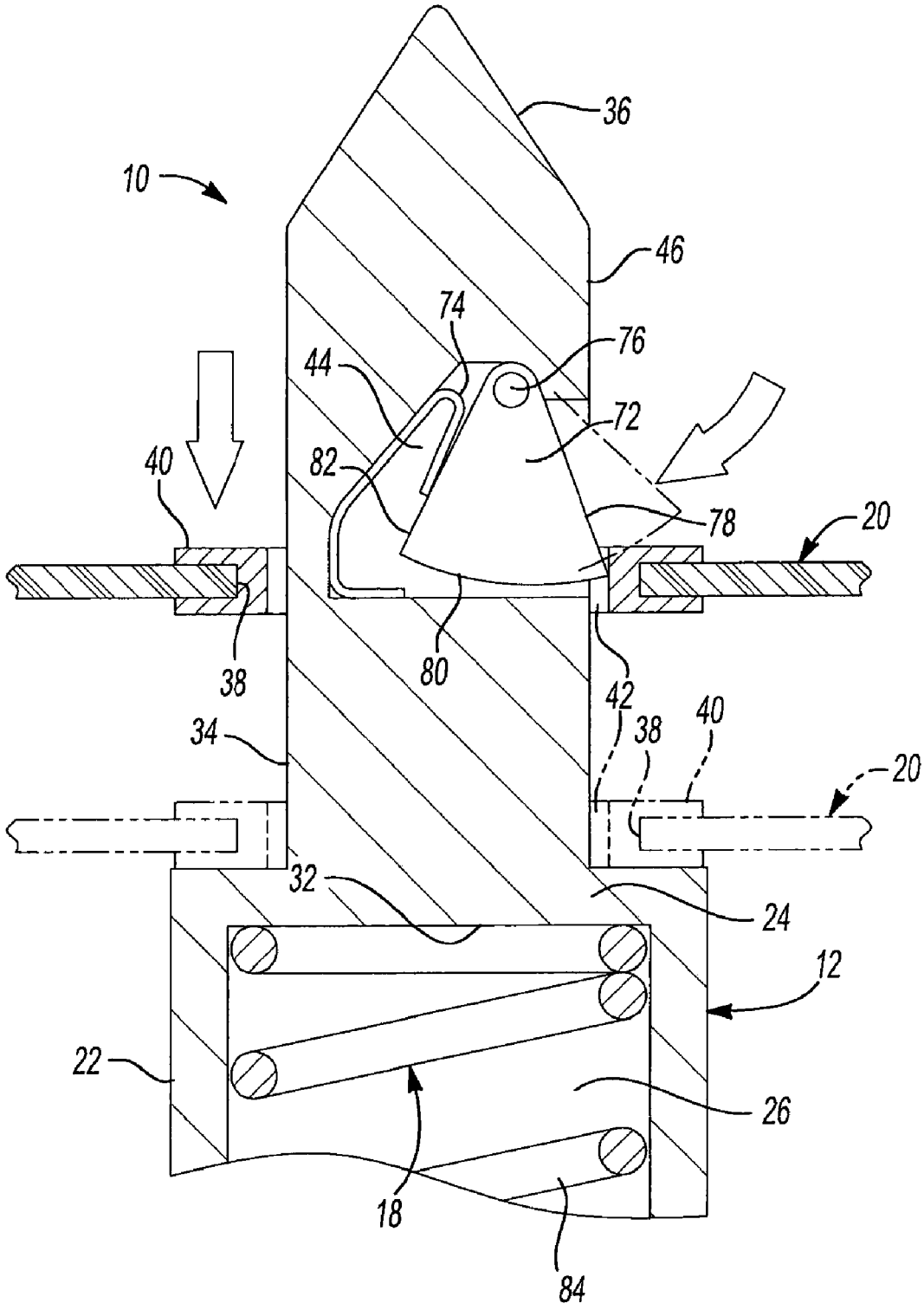
FIG. 5 is a cross-sectional view of a locking mechanism of the support pole of FIG. 2.

With particular reference to FIGS. 3-5, operation of the support pole 10 will be described in detail. The cover 20 may be inserted over the post 34 of the support pole 10 by positioning the eyelet 40 relative to the tapered end 36 of the post 34. The eyelet 40 may be slid over the tapered end 36 and may engage the tapered surface 78 of the locking tab 72. Engagement between the eyelet 40 and the tapered surface 78 of the locking tab 72 causes the locking tab 72 to move from the extended position to the retracted position against the bias of biasing member 74. Once the locking tab 72 has been sufficiently moved into the retracted position (i.e., in the clockwise direction relative to the view shown in FIG. 5) and is disposed generally within the recess 44 of the post 34, the eyelet 40 may be positioned at a base of the post 34 generally proximate to a junction of the post 34 and the top cap 24.

When the eyelet 40 is disposed at the junction of the post 34 and the top cap 24, the biasing member 74 once again imparts a rotational force on the locking tab 72 causing the locking tab 72 to rotate in the counterclockwise direction relative to the view shown in FIG. 5 about pin 76 such that the locking tab 72 is moved into the extended position and extends away from the outer surface 46 of the post 34. In this position, the eyelet 40 is prevented from being removed from the post 34 due to the locking tab 72 being in the extended position. Specifically, if the eyelet 40 is sufficiently moved along the outer surface 46 of the post 34 toward the tapered end 36, the eyelet 40 will contact the arcuate surface 80 of the locking tab 72. Engagement between the arcuate surface 80 of the locking tab 72 and the eyelet 40 of the cover 20 prevents removal of the eyelet 40 and, thus, the cover 20 from the post 34.

The upper support member 12 imparts a force on the cover 20 due to interaction between the top cap 24 and the eyelet 40 and the cover 20. The applied force is generally opposite to the X direction (schematically shown by an arrow in FIG. 4) and is achieved due to interaction between the biasing element 18 and the upper and lower support members 12, 14.

The biasing element 18 applies a force on the upper support member 12, causing the upper support member 12 to move away from the lower support member 14 due to interaction between the biasing element 18 and the engagement surface 32 of the upper support member 12 and the engagement surface 60 of the lower support member 14. Movement of the upper support member 12 away from the lower support member 14 (i.e., in a direction opposite to the X direction) causes the upper support member 12 to apply a force on the cover 20 via interaction between the cover 20 and the top cap 24 of the upper support member 12. The applied force provides the cover 20 with a desired pitch and places the cover 20 under tension to improve the ability of the cover 20 to repel debris such as water, leaves, and/or snow.

The cover 20 may be subjected to a force in the X direction due to debris on the cover 20 or to wind conditions. Furthermore, because the support pole 10 may be used with various covers having different weights and sizes, the cover 20 may impart a force on the support pole 10 in the X direction that overcomes the biasing element 18 if the cover 20 exceeds a predetermined weight. In either situation, if a force is applied in the X direction by the cover 20 on the support pole 10, the biasing element 18 maintains an upward force on the upper support member 12 to oppose the applied force.

If a force is applied to the upper support member 12 in the X direction (FIG. 4), the upper support member 12 may move against the force of the biasing element 18 and towards the lower support member 14. Movement of the upper support member 12 towards the lower support member 14 causes the pin 66 to move within the slot 30 of the upper support member 12 and causes compression of biasing element 18. Movement of the upper support member 12 toward the lower support member 14 continues until the upper support member 12 is in a position relative to the lower support member 14 where the biasing element 18 overcomes the force applied in the X direction. At this point, the upper support member 12 is static relative to the lower support member 14, as the applied force in the X direction and the force applied opposite the X direction by the biasing element 18 are in a state of equilibrium. The position of the upper support member 12 relative to the lower support member 14 and, thus, the position of the pin 66 within each slot 30 may be dictated by the applied force in the X direction and the ability of the biasing element 18 to withstand the force. In any event, the overall length of each slot 30 dictates the overall travel of the upper support member 12 relative to the lower support member 14.

As the pin 66 translates within the slots 30, the position of the pin 66 relative the numerical graduations 33 of the indicator 31 can indicate the magnitude of the force applied to the support pole 10 in the X direction. The force can be used to determine if the tension imparted on the cover 20 by the support pole 10 during installation is within a predetermined tension range.

The force applied into the support pole 10 in the X direction may be caused by a transient event such as a gust of wind or a heavy rainstorm. Once the event has subsided, the force in the X direction is alleviated and the biasing element 18 may once again move the upper support member 12 relative to and away from the lower support member 14. As previously discussed, such movement imparts a force on the cover 20 to maintain the cover 20 under tension and at a desired pitch. Placing the cover 20 under tension and at a desired pitch improves the ability of the cover 20 to repel debris such as water and leaves.

Figure 6:
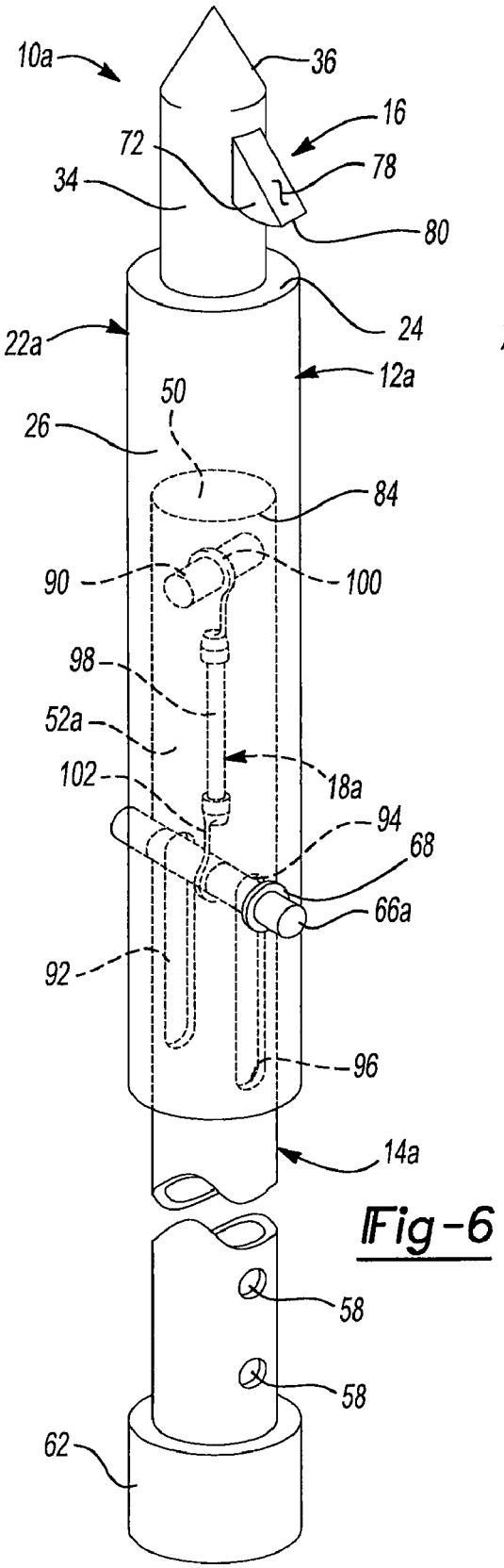
FIG. 6 is a perspective view of a support pole in accordance with the principles of the present teachings.
Figure 7:
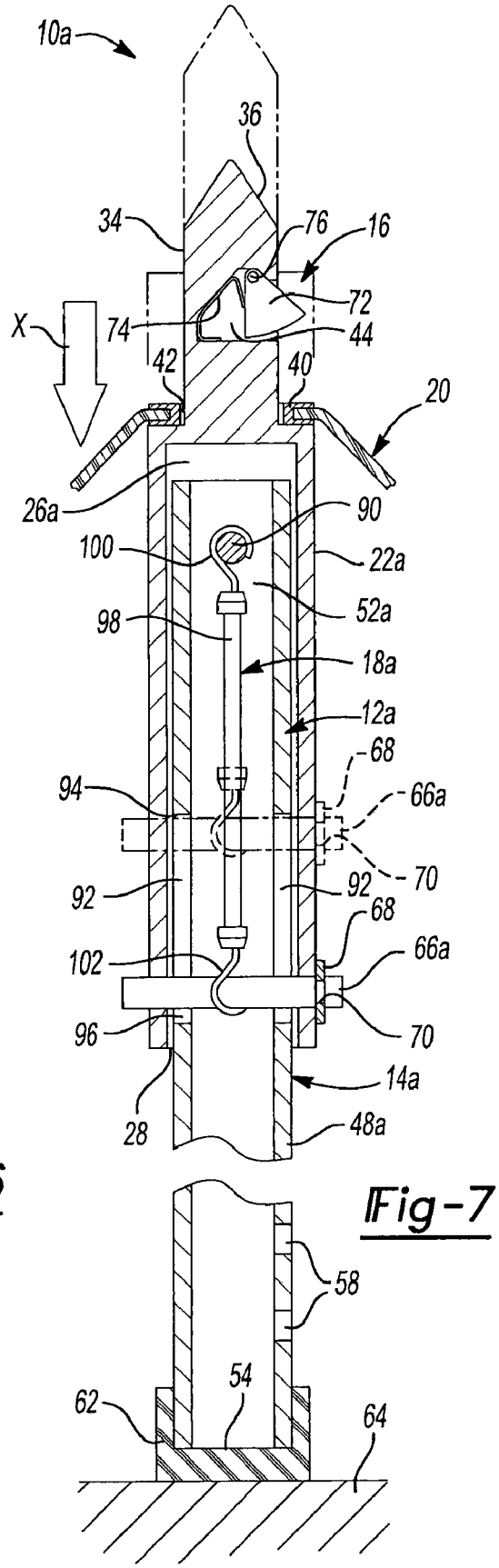
FIG. 7 is a cross-sectional view of the support pole of FIG. 6 in a deflected position with part of a cover shown to illustrate the relationship between the support pole and a cover.

With particular reference to FIGS. 6 and 7, another support pole 10*a* is provided. In view of the substantial similarity in structure and function of components associated with the support pole 10 with respect to the support pole 10*a*, like reference numerals are used hereinafter and in the drawings to identify like components, while like reference numerals containing letter extensions are used to identify both components that have been modified.

The support pole 10*a* may include an upper support member 12*a*, a lower support member 14*a*, and a biasing element 18*a* disposed generally between the upper support member 12*a* and the lower support member 14*a*. The upper support member 12*a* may include a cylindrical body 22*a* and a top cap 24 cooperating to define an inner volume 26*a*. The lower support member 14*a* may similarly include a cylindrical body 48*a* and a top cap 50 that cooperate to define an inner volume 52*a*.

The lower support member 14*a* may also include a spring post 90 disposed within the inner volume 52*a* and fixedly attached to the cylindrical body 22*a* and a pair of slots 92 disposed generally between the spring post 90 and the opening 54 of the lower support member 14*a*. The slots 92 may each include a first end 94 and a second end 96. A pin 66*a* may be slideably received within the slots 92 and may be moveable between the first end 94 and the second end 96 to define the overall range of motion of the upper support member 12*a* relative to the lower support member 14*a*.

The pin 66*a* may be fixedly attached to the upper support member 12*a* such that the pin 66*a* is fixed for movement with the upper support member 12*a*. The pin 66*a* may be retained within each slot 92 by a plurality of collars 68. Each collar 68 may be received in an annular groove 70 formed in both ends of the pin 66*a*. The collars 68 may cooperate with the grooves 70 to prevent removal of the pin 66*a* from the upper support member 12*a* and the slots 92 of the lower support member 14*a*. While a plurality of collars 68 and a groove 70 on both ends of the pin 66*a* is disclosed, any suitable device that prevents removal of the pin 66*a* from the upper support member 12*a*, such as a cotter pin, spring loaded clevis pin, dowel pin, hair pin, or expansion pin, is anticipated.

The biasing element 18*a* may be a bungee cord having an elastic body 98 extending between a first hook portion 100 and a second hook portion 102. The biasing element 18*a* may be disposed within the inner volume 52*a* of the lower support member 14*a* to bias the upper support member 12*a* away from the lower support member 14*a* and into engagement with the cover 20. To impart the biasing force on the upper support member 12*a*, the first hook portion 100 of the biasing element 18*a* may be fixedly attached to the spring post 90 of the lower support member 14*a* while the second hook portion 102 may be fixedly attached to the pin 66*a* such that the second hook portion 102 is fixed for movement with the upper support member 12*a*.

Because the biasing element 18*a* includes an elastic body 98 extending between the first hook portion 100 and the second hook portion 102, the first and second hook portions 100, 102 are drawn together, thereby causing the biasing element 18*a* to impart a force on the upper support member 12*a*. The applied force biases the upper support member 12*a* away from the lower support member 14*a* and into engagement with the cover 20. Biasing the upper support member 12*a* into engagement with the cover 20 causes the cover 20 to be placed under tension and at a predetermined pitch and therefore improves the ability of the cover 20 to resist collection of water and/or other debris on a top surface thereof. While the biasing element 18*a* has been described as a bungee cord, the biasing element 18*a* may be any element having an elastic body that biases the upper support member 12*a* into engagement with the cover 20, such as an o-ring, rubber band, or extension spring.

The upper support member 12*a* may include locking mechanism 16 to attach the support pole 10*a* to the cover 20. Attachment of the upper support member 12*a* to the cover 20 using locking mechanism 16 is similar to attachment of the support pole 10 to the cover 20, as described above. Once the post 34 extends through the eyelet 40 of the cover 20, the locking tab 72 may be urged into the extended position by the biasing member 74 to prevent removal of the cover 20 from the upper support member 12*a*. In this position, the cover 20 is fixed to the upper support member 12*a* and is placed under tension due to the upward force imparted on the upper support member 12*a* by the biasing element 18*a*.

Attachment of the upper support member 12*a* to the cover 20 places the cover 20 under tension due to the relationship between the upper support member 12*a*, the lower support member 14*a*, and the biasing element 18*a*. Specifically, because the biasing element 18*a* imparts a force on the upper support member 12*a* via the pin 66*a*, the upper support member 12*a* moves relative to and away from the lower support member 14*a*. Movement of the upper support member 12*a* relative to and away from the lower support member 14*a* causes the upper support member 12*a* to impart a force on the cover 20 and place the cover 20 under tension.

In operation, the cover 20 may experience various forces such as wind and/or snow that may cause the cover 20 to exert a downward force on the support pole 10*a* (in the X direction, schematically represented in FIG. 7). Exertion of a force on the support pole 10*a* in the X direction may cause the upper support member 12*a* to move toward the lower support member 14*a* and against the bias of the biasing element 18*a*. Movement of the upper support member 12*a* toward the lower support member 14*a* causes the pin 66*a* to move away from the first end 94 of the slots 92 toward the second end 96 of the slots 92. Even when the cover 20 imparts a downward force on the support pole 10*a* causing the upper support member 12*a* to move towards the lower support member 14*a*, the biasing element 18*a* maintains a force on the upper support member 12*a* that resists motion of the upper support member 12*a* toward the lower support member 14*a*. The resistance imparted on the upper support member 12*a* by the biasing element 18*a* maintains an upward force of the upper support member 12*a* on the cover 20 to maintain a tensile force and predetermined pitch on the cover 20.

Figure 8:
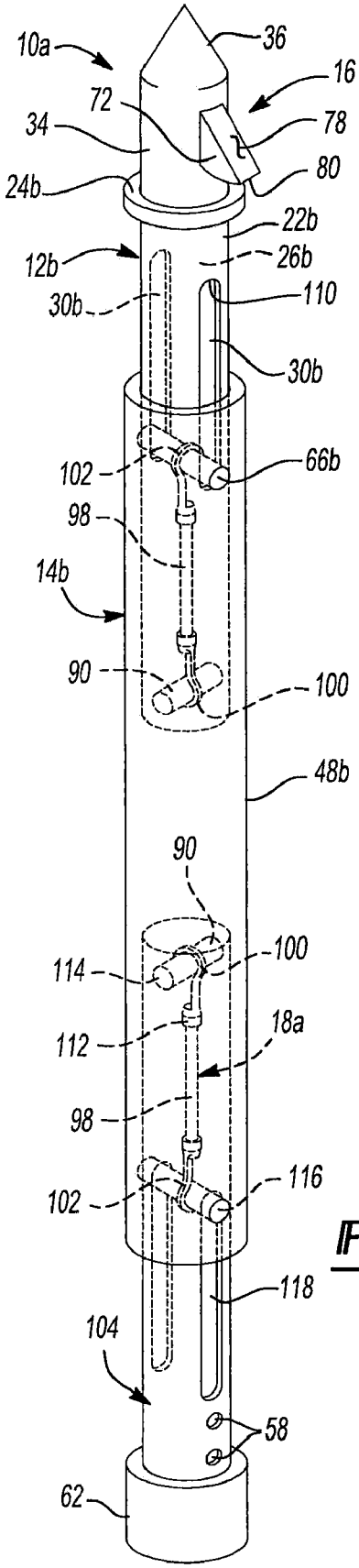
FIG. 8 is a perspective view of a support pole in accordance with the present teachings.
Figure 9:
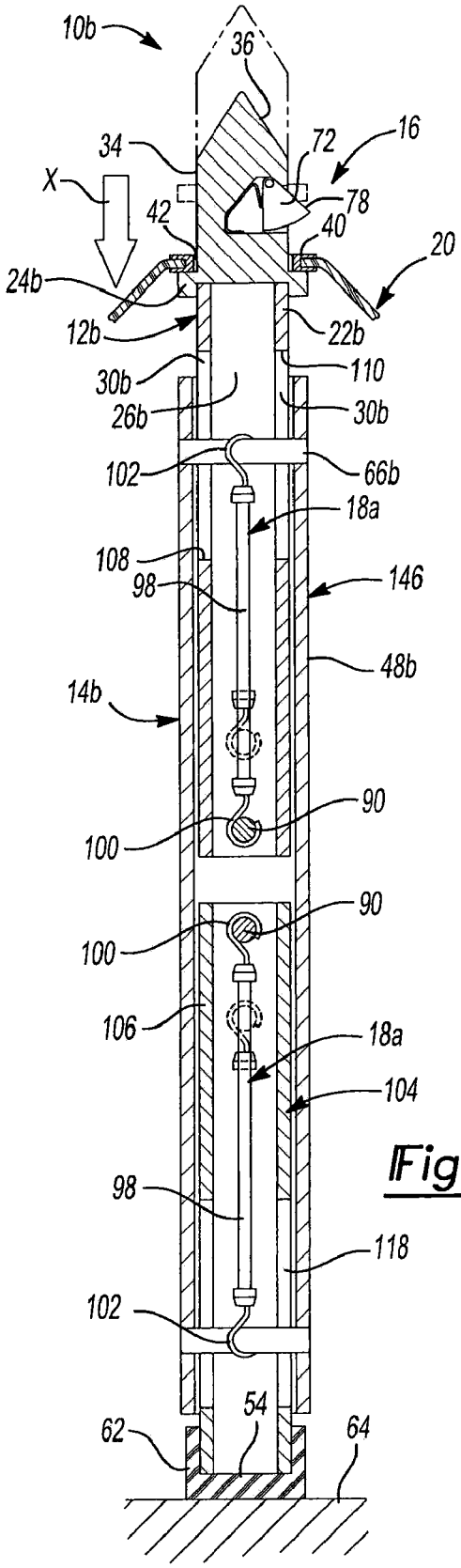
FIG. 9 is a cross-sectional view of the support pole of FIG. 8 in a deflected position with part of a cover shown to illustrate the relationship between the support pole and a cover.

With reference to FIGS. 8 and 9, another support pole 10*b* in accordance with the principles of the present teachings is provided. In view of the substantial similarity in structure and function of the components associated with the support pole 10 with respect to the support pole 10*b*, like reference numerals are used hereinafter and in the drawings to identify like components while like reference numerals containing letter extensions are used to identify those components that have been modified.

The support pole 10*b* may include an upper support member 12*b*, a lower support member 14*b*, and a bottom support member 104. Each of the upper support member 12*b* and the bottom support member 104 may be telescopically received within the lower support member 14*b* at opposite ends of the lower support member. A biasing element 18*a* may be disposed between the upper support member 12*b* and the lower support member 14*b*, causing the upper support member 12*b* to be biased in a direction generally toward the cover 20 and away from the lower support member 14*b*. Similarly, a biasing element 18*a* may be disposed between the lower support member 14*b* and the bottom support member 104, causing the lower support member 14*b* to be biased in a direction generally away from the bottom support member 104.

The upper support member 12*a* may include a cylindrical body 22*b* cooperating with a top cap 24*b* to define an inner volume 26*b*. A spring post 90 may be disposed generally within the inner volume 26*b* and may be fixedly attached to the cylindrical body 22*b*.

The biasing element 18*b* may be disposed generally within the inner volume 26*b* of the upper support member 12*b* and may be disposed generally between the spring post 90 and a pin 66*b*. The biasing element 18*a* may include a first hook portion 100 fixedly attached to the spring post 90 and a second hook portion 102 fixedly attached to the pin 66*b*. An elastic body 98 of the biasing element 18*a* may impart a force on the first and second hook portions 100, 102 urging the first and second hook portions 100, 102 toward one another. Urging the first and second hook portions 100, 102 together causes the upper support member 12*b* to move relative to the lower support member 14. Movement of the upper support member 12*b* causes the upper support member 12*b* to move into engagement with the cover 20 and impart a force on the cover 20 to place the cover 20 under tension and at a predetermined pitch. While the biasing element 18*a* has been described as a bungee cord, the biasing element 18*a* may be any element having an elastic body that biases the upper support member 12*a* into engagement with the cover 20, such as an o-ring, rubber band, or extension spring.

Maintaining the force on the upper support member 12*b* provides the support pole 10*b* with two functions. First, maintaining the upward force on the upper support member 12*b* allows the upper support member 12*b* to move away from the lower support member 14*b* and impart a tensile force on the cover 20. Allowing the upper support member 12*b* to place the cover 20 under tension provides the cover 20 with a predetermined pitch to improve the ability of the cover 20 to repel water and/or other debris.

Second, maintaining the upward force on the upper support member 12*b* also allows the support pole 10*b* to maintain the cover 20 under tension even when the cover 20 is caused to move toward the lower support member 14*b* (i.e., when a force is applied to the cover 20 in the X direction (FIG. 9)). Allowing the upper support member 12*b* to maintain tension on the cover 20 when the cover 20 is moved in the X direction allows support pole 10*b* to be used with various covers 20 having different sizes and weights.

For example, a light cover 20 would not impart a large force in the "X" direction on the upper support member 12*b*. The biasing element 18*a* would be allowed to bias the upper support member 12*b* away from the lower support member 14*b* until pin 66*b* is in contact with end 108 of slots 30*b*. If a heavier cover is used, the cover 20 may apply a force on the support pole 10*b* causing the upper support member 12*b* to move in the X direction (FIG. 9) toward the lower support member 14*b* and against the bias imparted on the upper support member 12*b* by the biasing element 18*a*. Such movement causes the upper support member 12*b* to disengage end 108 of the slots 30*b* and move towards a second end 110 of each slot 30*b*. Based on the force exerted on the upper support member 12*b* by the cover 20, the pin 66*b* may be located along each slot 30*b* generally between the first and second ends 108, 110. When the upper support member 12*b* may move towards the lower support member 14*b* such that the upper support member 12*b* moves relative to the pin 66*b* of the lower support member 14*b* and along the slots 30*b* between the first and second ends 108, 110, the biasing element 18*a* maintains a force on the upper support member 12*b* causing the upper support member 12*b* to impart a force on the cover 20. Maintaining the force on the cover 20 places the cover 20 under tension and at a desired pitch and improves the ability of the cover 20 to repel debris such as water and/or snow.

The biasing member 18*a* may be disposed between the lower support member 14*b* and the bottom support member 104 to further improve the ability of the support pole 10*b* to impart a force on the cover 20 and maintain tension on the cover 20. Specifically, the biasing member 18*a* may be positioned within an inner volume 112 of the bottom support member 104. The biasing member 18*a* may be fixedly attached at a first hook portion to a post 114 that is fixedly attached to the bottom support member 104 within inner volume 112 and may be fixedly attached at a second hook portion 102 to a pin 116 that is fixedly attached to the lower support member 14*b* and is slideably received within a pair of slots 118 of the bottom support member 104. The pin 116 may be fixedly attached to the cylindrical body 48*b* of the lower support member 14*b* such that movement of the pin 116 is fixed for movement with the lower support member 14*b*.

In operation, the biasing element 18*b* imparts a force on the lower support member 14*b* due to interaction between the pin 116 and the lower support member 14*b*. Imparting a force on the lower support member 14*b* causes the lower support member 14*b* to move away from the bottom support member 104 such that the post 34 of the upper support member 12*b* moves upward and toward the cover 20 to impart a force on the cover 20. As discussed above, imparting a force on the cover 20 causes the cover 20 to be placed under tension and provides the cover with a desired pitch to improve the ability of the cover 20 to repel debris.

If a force is applied in the X direction (FIG. 9) such that the upper support member 12*b* moves towards the lower support member 14*b*, the force may also be transmitted from the upper support member 12*b* to the lower support member 14*b*. Movement of the upper support member 12*b* toward the lower support member 14*b* is resisted by biasing element 18*a* disposed between the upper support member 12*b* and the lower support member 14*b*, hereinafter referred to as first biasing element 18*a*.

The applied force may cause the lower support member 14*b* to move downward and towards the bottom support member 104 and against the bias of biasing element 18*a* disposed generally between the lower support member 14*b* and the bottom support member 104, hereinafter referred to as second biasing element 18*a*. The force applied to the lower support member 14*b* by the second biasing element 18*a* causes the lower support member 14*b* to resist motion of the lower support member 14*b* in the X direction. By resisting motion of the lower support member 14*b* in the X direction, a force may be maintained on the cover 20, maintaining the cover 20 under tension.

When pins 66*b*, 116 are free to traverse slots 30*b*, 118 respectively, the combination of the first and second biasing elements 18*a* create an initial spring rate for the support pole 10*b* that generates a force to maintain the cover 20 under tension. When the pin 66*b* has traversed the full length of the slots 30 and relative movement between the upper support member 12*b* and the lower support member 14*b* is prevented, the first biasing element 12*b* is no longer active, and the spring rate of the pole 10*b* is equal to the spring rate of the second biasing element 12*b*. The first and second biasing elements 18*a* may include different spring rates such that the support pole 106 has a first spring rate when the pin 66*b* is free to traverse the slot 30 and a second spring rate when the pin 66*b* is prevented from traversing the slot.

For example, the second biasing element 18*a* may include a spring rate that is greater than the spring rate of the first biasing element 18*a*. The spring rate of the first biasing element 18*a* can be selected to accommodate initial installation of the support pole 10*b* and achieve the desired amount of tension imparted on the cover 20. When the cover 20 is subjected to a transient force, such as, for example, a gust of wind, the additional force imparted on the support pole 10*b* in the X direction may cause the pins 66*b* to bottom out in respective slots 30, thereby rendering the first biasing element 18*a* inactive and the spring rate of the pole 10*b* generally equal to the spring rate of the second biasing element 18*a*.

The spring rate of the second biasing element 18*a* may be such that the second biasing element 18*a* compensates for a transient force while only permitting a small amount of relative movement between the upper support member 12*a* and the bottom support member 104. The higher spring rate permits the support pole 10*b* to absorb transient forces while continuing to support the cover 20.

Cooperation between the upper support member 12*b*, lower support member 14*b*, and bottom support member 104 maintains the cover 20 under tension and therefore improves the ability of the cover 20 to repel debris. Furthermore, cooperation between the upper support member 12*b*, lower support member 14*b*, and bottom support member 104 allows the support pole 10*b* to be used with a variety of covers having different shapes and weights, as discussed above with respect to support poles 10, 10*a*.

Figure 10:
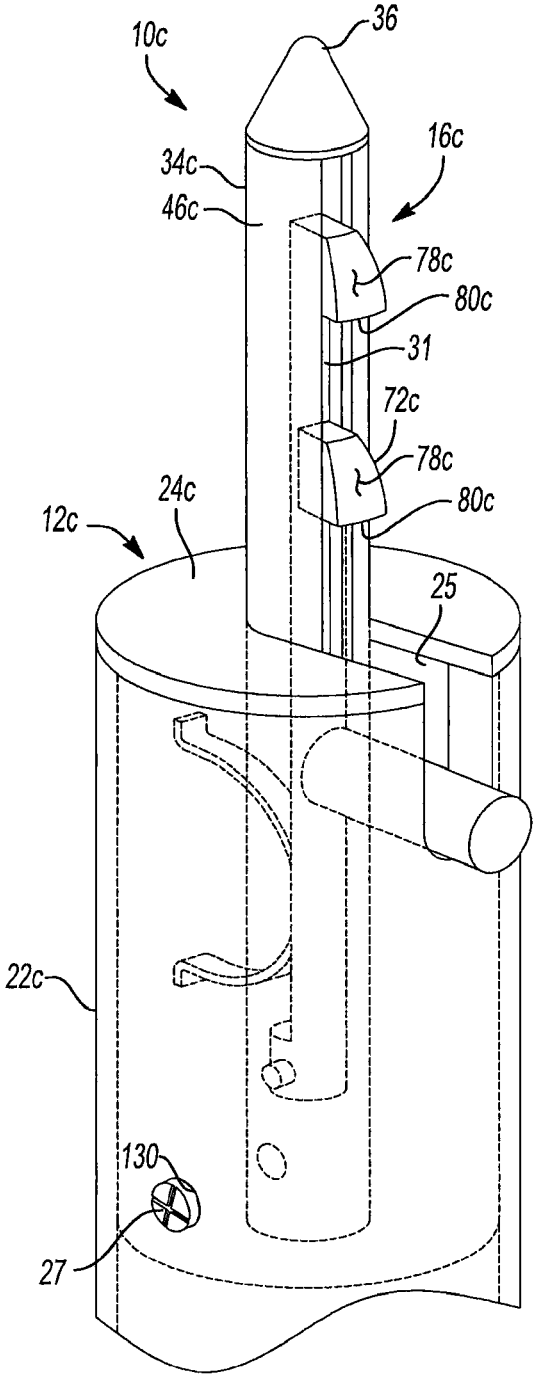
FIG. 10 is a perspective view of a support pole in accordance with the principles of the present teachings.
Figure 11:
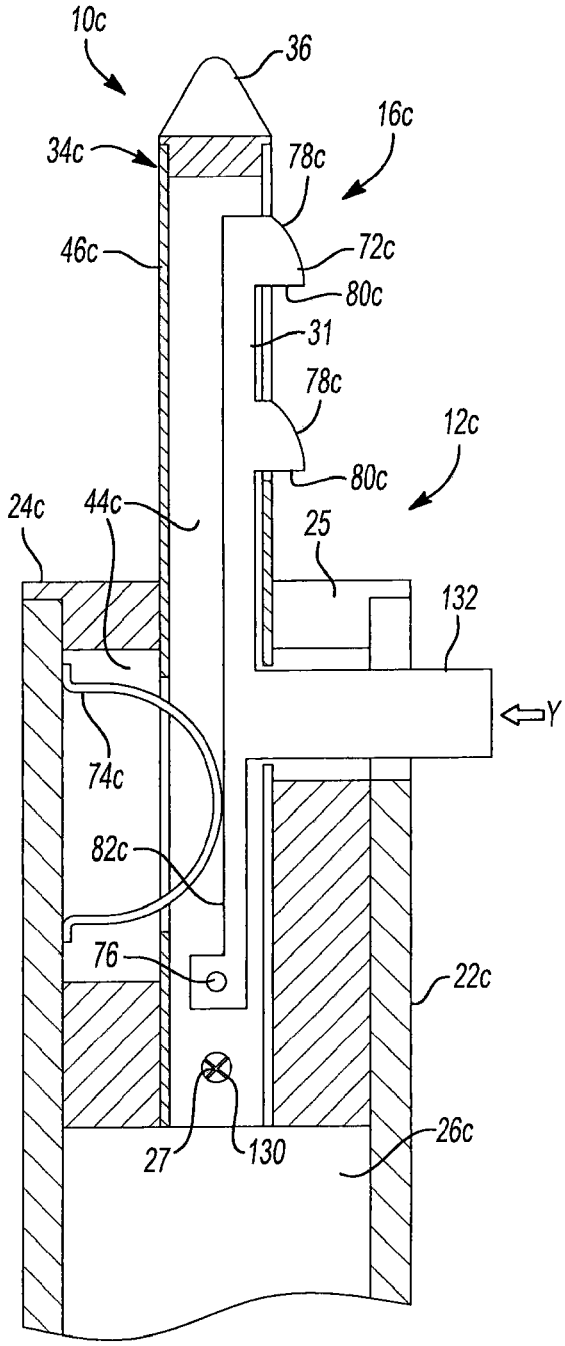
FIG. 11 is a cross-sectional view of a locking mechanism of the support pole of FIG. 10.

With particular reference to FIGS. 10 and 11, another support pole 10*c* in accordance with the principles of the present teachings is provided. A locking mechanism 16*c* may be associated with the support pole 10*c* and may be moveable between an extended position, preventing removal of the support pole 10*c* from the cover 20 and a retracted position permitting removal of the support pole 10*c* from the cover 20. In view of the substantial similarity in structure and function of components associated with the support pole 10 with respect to the support pole 10*c*, like reference numerals are used hereinafter and in the drawings to identify like components, while like reference numerals containing letter extensions are used to identify components that have been modified.

The support pole 10*c* may include an upper support member 12*c* having an elongate tubular body 22*c* cooperating with a top cap 24*c* to define an inner volume 26*c* and a tubular post 34*c* extending through the top cap 24*c*. The tubular body 22*c* may receive the cylindrically shaped top cap 24*c* in an inner diameter at one end thereof. The top cap 24*c* may include an opening 25 extending therethrough that receives the post 34*c*. The post 34*c* may include a tapered end 36 extending from the top cap 24*c* to facilitate insertion of the post 34*c* into an eyelet 40 of a cover 20. A fastener 27 may extend through an aperture 130 to couple the top cap 24*c* and the post 34*c* arrangement to the body 22*c*.

Figure 2:
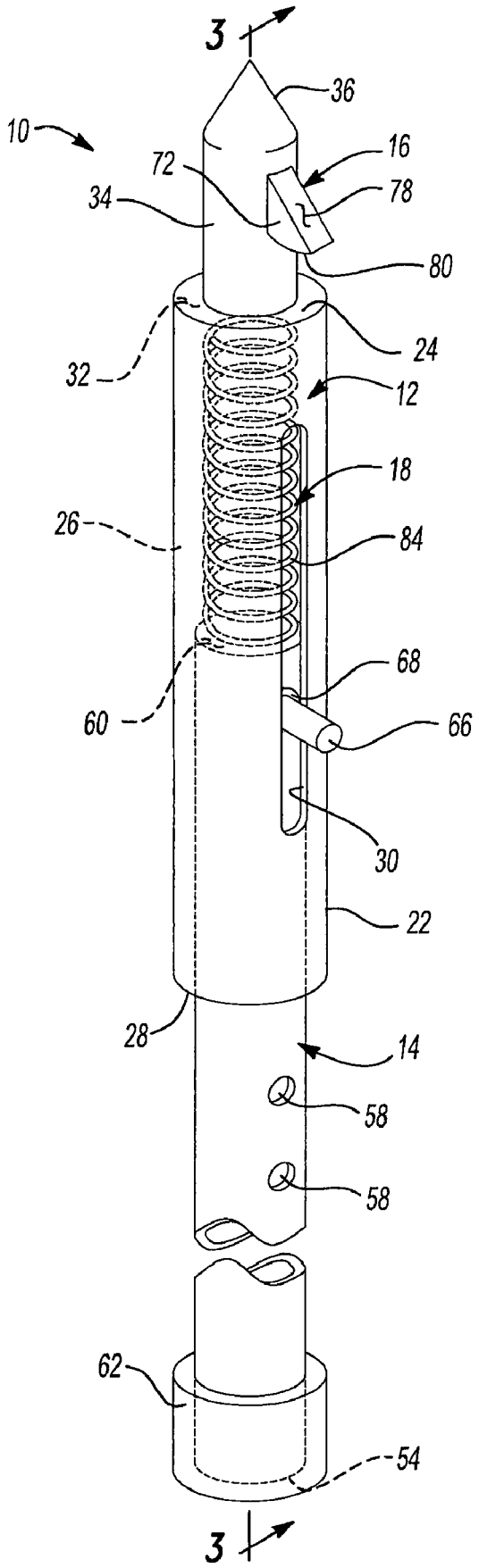
FIG. 2 is a perspective view of a support pole in accordance with the principles of the present teachings.

A locking mechanism 16*c* and biasing member 74*c* may be supported by the tubular body 22*c* generally within a cavity 44*c* formed in the upper support member 12*c* and post 34*c*. The locking mechanism 16*c* may be pivotally attached to the upper support member 12*c* by a pin 76 and may be rotatable between an extended position (FIG. 2) and a retracted position. A first end of the biasing member 74*c* may abut the body 22*c* of the upper support member 12*c* while a second end abuts an engagement surface 82*c* of the locking mechanism 16*c* to impart a rotational force on the locking mechanism 16*c* and cause the locking mechanism 16*c* to rotate about pin 76 in the clockwise direction relative to the view shown in FIG. 11 and into the extended position. While the biasing member 74*c* is shown as a leaf spring, any suitable biasing member such as, but not limited to, a coil spring or a linear spring, could additionally or alternatively be used.

The locking mechanism 16*c* may also include an actuation arm 132 disposed between at least one locking tab 72*c* and the pin 76. A portion of the actuation arm 132 may extend through the upper support member 12*c* and be actuated by imparting a force in direction Y (FIG. 11). When the applied force is sufficient to overcome the force of the biasing member 74*c*, the locking mechanism 16*c* will rotate about the pin 76 and retract a pair of locking tabs 72*c* into the post 34*c* of the upper support member 12*c*. While a pair of locking tabs 72*c* are disclosed, any number of locking tabs 72*c* could be employed.

When the locking tabs 72*c* of the locking mechanism 16*c* are retracted into the post 34*c*, an outer surface 78*c* of each locking tab 72*c* will be flush with or recessed from an outer surface 46*c* of the post 34*c*. When the force in direction Y is disengaged, the rotational force imparted on the locking mechanism 16*c* by the biasing member 74*c* may once again pivot the locking mechanism 16*c* about pin 76 and into the extended position. When the locking mechanism 16*c* is returned to the extended position, the locking tabs 72*c* extend from the post 34*c*. When the tabs 72*c* extend from the post 34*c*, the surface 78*c* of each tab 72*c* extends from the outer surface 46*c* of the post 34*c* and remains in the extended position until a force is once again applied to the actuation arm 132 in the Y direction.

The tabs 72*c* of the locking mechanism 16*c* may include a locking surface 80*c* extending generally between a main body 31 of the locking mechanism 16*c* and a surface 78*c* of each tab 72*c*. The locking surface 80*c* extends generally from an outer surface 46*c* of the post 34*c* when the locking mechanism 16*c* is in the extended position. When a force is applied in the Y direction to the actuation arm 132, the locking surface 80*c* is similarly retracted within the post 34*c* with surfaces 78*c*. Therefore, when the locking mechanism 16*c* is positioned into the retracted position, both surfaces 78*c* and locking surfaces 80*c* are retracted into an interior portion of the post 34*c* such that the surfaces 78*c* are flush with or retracted from the outer surface 46*c* of the post 34*c*.

With continuing reference to FIGS. 10 and 11, operation of the support pole 10*c* will be described in detail. A cover 20 may be inserted over the post 34*c* by positioning an eyelet 40 of the cover 20 relative to the tapered end 36 of the post 34*c*. The eyelet 40 may be slid over the tapered end 36 and may engage the tapered surface 78*c* of the locking tab 72*c*. Engagement between the eyelet 40 and the tapered surface 78*c* of the locking tab 72*c* causes the locking tab 72*c* to move from the extended position to the retracted position against the bias of biasing member 74*c*. Once the locking tab 72*c* has been sufficiently moved into the retracted position (i.e., in the clockwise direction relative to the view shown in FIG. 11) and is disposed generally within the post 34*c*, the eyelet 40 may be positioned at a base of the post 34*c* generally proximate to a junction of the post 34*c* and the top cap 24*c*.

When the eyelet 40 is disposed at the junction of the post 34*c* and the top cap 24*c*, the biasing member 74*c* once again imparts a rotational force on the locking mechanism causing the locking tab 72*c* to rotate such that the locking tab 72*c* is moved into the extended position and extends away from the outer surface 46*c* of the post 34*c*. In this position, the eyelet 40 is prevented from being removed from the post 34*c* due to the locking tab 72*c* being in the extended position. Specifically, if the eyelet 40 is sufficiently moved along the outer surface 46 of the post 34*c* toward the tapered end 36, the eyelet 40 will contact the locking surface 80*c* of the locking tab 72*c*. Engagement between the locking surface 80*c* and the eyelet 40 inhibits removal of the eyelet 40 and, thus, the cover 20 from the post 34*c* unless and until the locking mechanism 16*c* is returned to the retracted position.

To remove the cover 20, a force is applied to the actuation arm 132 in the Y direction to rotate and locking tab 72*c* from the extended position to the retracted position. Once the locking tab 72*c* has been sufficiently moved into the retracted position and is disposed generally within the post 34*c*, the eyelet 40 may be slid along the post 34*c* in a direction toward the tapered end 36. When the eyelet 40 is positioned between the locking tab 72*c* and the tapered end 36, the eyelet 40 may be removed from the post 34*c* and the force applied to the disengagement arm can be released. After the force is released, the biasing member 74*c* once again biases the locking mechanism 16*c* into the extended position, thereby causing the locking tabs 72*c* to extend from the outer surface 46*c* of the post 34*c*.

Figure 12:
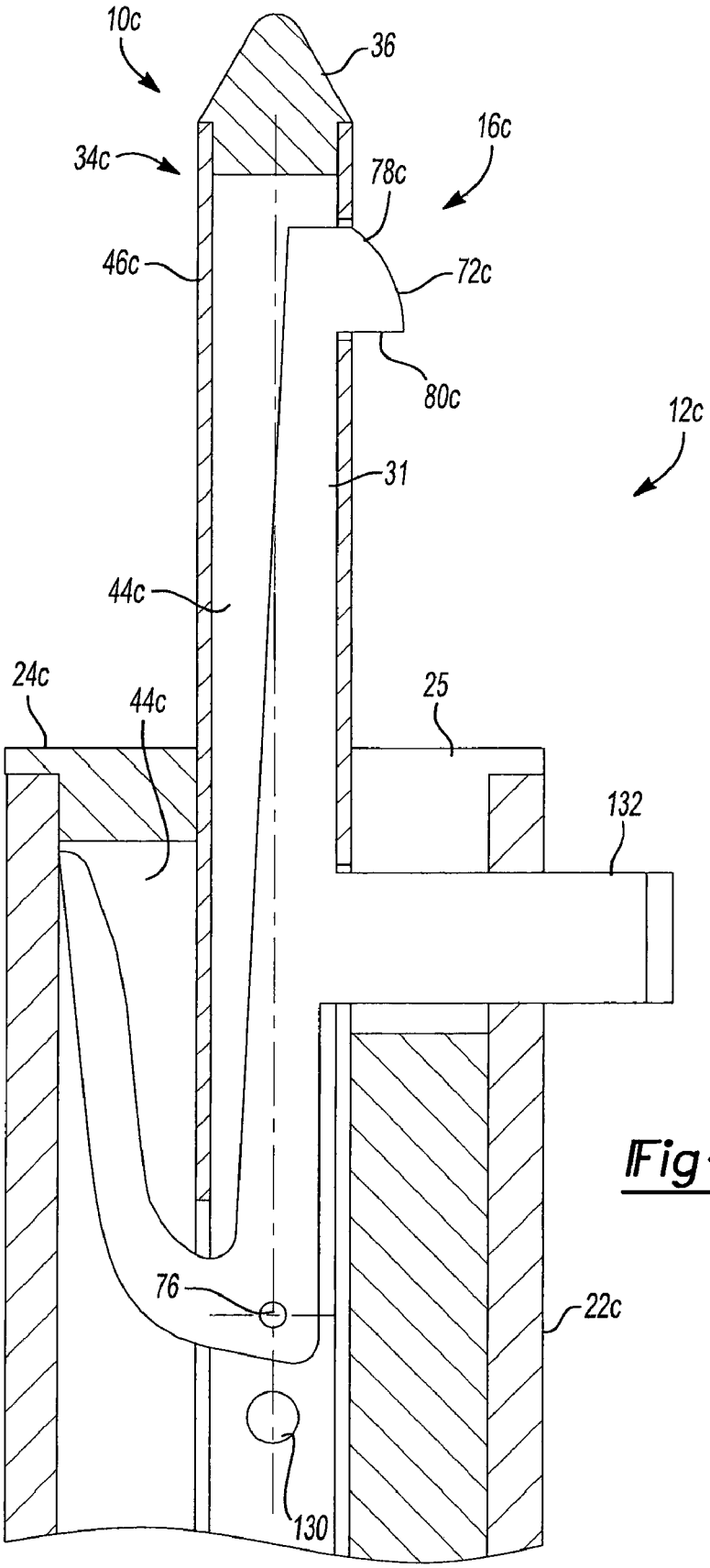
FIG. 12 is a cross-sectional view of an alternate locking mechanism of the support pole of FIG. 10.

Referring now to FIG. 12, an alternate locking mechanism 16*d* having an integral biasing member 74*d* is provided. The alternate locking mechanism 16*d* and biasing member 74*d* may be used in place of the locking mechanism 16*c* and biasing member 74*d*. The locking mechanism 16*d* may similarly be rotatable between an extended position and a retracted position, as described above with respect to the locking mechanism 16*c*.

The locking mechanism 16*d* may be integrally formed with the biasing member 74*d* and may be molded from a suitable flexible material such as, but not limited to, plastic. The biasing member 74*d* may include a first leg 134 that protrudes from a body 136 of the locking mechanism 16*d* and a second leg 138 that protrudes from the first leg 134 at an angle oblique to the body 136.

The locking mechanism 16*d* may be supported within the cavity 44*c* of the upper support member 12*c* and may apply a biasing force to the locking mechanism 16*d* to urge the locking tab 72*c* into the extended position. While a single locking tab 72*c* is shown, the locking mechanism 16*d* may include multiple locking tabs 72*c* (FIGS. 10 and 11).

The locking mechanism 16*d* may be pivotally supported within the cavity 44*c* by a pin 76 between the retracted position and the extended position. When a force is applied to the actuation arm 132, the locking tab 72*c* is moved into the cavity 44*c* of the upper support member 12*c* and the main body 136 pivots about pin 76. The biasing member 74*d* remains in the retracted position until the force applied in the Y direction to the actuation arm 132 is released. When the force is released, the locking tab 72*c* is returned to the extended position and extends generally from an outer surface 46*c* of the post 34*c*.

Any of the support poles 10, 10*a*, 10*b*, 10*c* may be used to support a cover 20 of a boat 122. The support poles 10, 10*a*, 10*b*, 10*c* may be of sufficient length such that the support poles 10, 10*a*, 10*b*, 10*c* extend from an external structure 64 of the boat 122 (i.e., a deck, for example) or may be used in conjunction with an existing support pole by attaching the support pole 10, 10*a*, 10*b*, 10*c* to the existing support pole.

What is claimed is:

1. A support assembly for a boat cover comprising:

a first support member having a first end disposed adjacent to the boat cover and a second end having an opening;

a second support member having a first end telescopically received within said opening;

an elastic cord disposed between said first end of said second support member and said first end of said first support member to bias said first support member away from said second support member and into engagement with the boat cover.

2. The support assembly of claim 1, further comprising a locking mechanism disposed at said first end of said first support member to retain said first support member in contact with the boat cover.

3. The support assembly of claim 2, wherein said locking mechanism includes a post extending from said first end and through said boat cover.

4. The support assembly of claim 3, wherein said post includes a retention element movable between an extended position preventing removal of said first support member from the boat cover and a retracted position permitting removal of said first support member from the boat cover.

5. The support assembly of claim 4, wherein said retention element is biased into said extended position by a biasing member.

6. The support assembly of claim 4, wherein said retention element includes a tapered surface operable to facilitate insertion of said locking mechanism into the boat cover.

7. The support assembly of claim 5, wherein said biasing element is a spring.

8. The support assembly of claim 1, wherein said second support member includes a pin and said first support member includes a slot, said pin slideably received within said slot to define a range of motion of said first support member relative to said second support member.

9. A support assembly for a boat cover comprising:

a first support member including an inner volume defined by at least one side wall and a top cap, said at least on side wall including a slot and said top cap disposed adjacent to the boat cover;

a second support member telescopically received within said inner volume and including a pin and a surface opposing said top cap, said pin slideably received within said slot to define a range of motion of said first support member relative to said second support member; and a biasing element disposed within said inner volume and between said top cap and said surface of said second support member to bias said first support member into engagement with the boat cover.

10. The support assembly of claim 9, further comprising a locking mechanism disposed on said top cap to retain said first support member in contact with the boat cover.

11. The support assembly of claim 10, wherein said locking mechanism includes a post extending from said top cap and through said boat cover.

12. The support assembly of claim 11, wherein said post includes a retention element movable between an extended position preventing removal of said first support member from the boat cover and a retracted position permitting removal of said first support member from the boat cover.

13. The support assembly of claim 12, wherein said retention element is biased into said extended position by a biasing member.

14. The support assembly of claim 12, wherein said retention element includes a tapered surface operable to facilitate insertion of said locking mechanism into the boat cover.

15. The support assembly of claim 9, wherein said biasing element is a spring.

16. The support assembly of claim 9, wherein said biasing element is an elastic cord.

17. A support assembly for a boat cover comprising:

a first support member having a first end disposed adjacent to the boat cover;

a biasing element urging said first support member into engagement with the boat cover; and a locking mechanism disposed on said first end of said first support member and including a locking tab operable between an extended position preventing removal said first support member from the boat cover and a retracted position permitting removal of said first support member from the boat cover.

18. The support assembly of claim 17, wherein said locking tab is biased into said extended position by a biasing member.

19. The support assembly of claim 17, wherein said locking tab includes a tapered surface to facilitate insertion of said locking tab into the boat cover.

20. The support assembly of claim 17, wherein said locking mechanism includes a post extending from said first end of said first support member.

21. The support assembly of claim 20, wherein said locking tab extends from said post in said extended position and is substantially within said post in said retracted position.

22. The support assembly of claim 17, further comprising a second support member telescopically received within said first support member.

23. The support assembly of claim 22, wherein said biasing element is disposed between said first support member and said second support member.

* * * * *